US008439123B2

(12) United States Patent
Bennett

(10) Patent No.: US 8,439,123 B2
(45) Date of Patent: May 14, 2013

(54) METHODS AND APPARATUS FOR CONTROLLING HAZARDS

(75) Inventor: Joseph Michael Bennett, Dayton, OH (US)

(73) Assignee: Firetrace USA, LLC, Scottsdale, AZ (US)

( * ) Notice: Subject to any disclaimer, the term of this patent is extended or adjusted under 35 U.S.C. 154(b) by 1305 days.

(21) Appl. No.: 11/566,063

(22) Filed: Dec. 1, 2006

(65) Prior Publication Data

US 2007/0107915 A1 May 17, 2007

Related U.S. Application Data

(63) Continuation of application No. 09/920,179, filed on Aug. 1, 2001, now abandoned.

(60) Provisional application No. 60/225,449, filed on Aug. 15, 2000.

(51) Int. Cl.
*A62C 2/00* (2006.01)
*A62C 3/00* (2006.01)

(52) U.S. Cl.
USPC ..... 169/46; 169/28; 169/58; 169/62; 428/73; 428/117

(58) Field of Classification Search ..... 169/62, 169/58, 26, 28; 428/73, 116, 117
See application file for complete search history.

(56) References Cited

U.S. PATENT DOCUMENTS 208,374 A 9/1878 Connelly et al.
2,912,054 A 11/1959 Mathisen (Continued)

FOREIGN PATENT DOCUMENTS

FR 635827 3/1928
GB 1380420 1/1975

(Continued)

OTHER PUBLICATIONS

The book "Principles of Fire Protection Chemistry, Second Edition" (Raymond Friedman, Nov. 1989), pp. 82-86, Table 6.5 and Figure 6.11 and p. 85.

(Continued)

*Primary Examiner* — Dinh Q Nguyen
(74) *Attorney, Agent, or Firm* — The Noblitt Group, PLLC

(57) ABSTRACT

A device for protecting flammable fluid reservoirs, or the regions in immediate proximity thereof, from the hazards due to impact and reservoir rupture, and subsequent potential of fire, corrosion or other damage or injury due to contact with reactive fluids. Such impacts may arise from collisions, such as encountered in transportation systems, or structural or thermal failure and/or rupture of components and systems, or separation of system components. Such a device may be formed as a close-fitting shroud over such components, or surrounding fittings and junctions of mating components in such systems, or mounted near the location of such components in the direction of impact or failure. Such a device may have a pattern of pre-scored lines to facilitate break-up of the device upon impact or thermal stress. Upon activation, the device shall discharge material contents that prevent or extinguish fires, neutralize corrosive or caustic materials, or otherwise protect equipment and personnel of the hazards from the protected component or system fluid contents. Such a device may be constructed of more than one individual component to optimize outer surface break-up behavior while accommodating desired cost, thickness and weight goals achievable by the use of other materials that comprise the remaining components of the device.

24 Claims, 4 Drawing Sheets

U.S. PATENT DOCUMENTS

| | | | | | |
|---|---|---|---|---|---|
| 3,322,294 | A | | 5/1967 | Nemeth | |
| T861043 | I4 | | 4/1969 | Gross et al. | |
| 3,689,597 | A | | 9/1972 | Mahlman | |
| 3,764,035 | A | | 10/1973 | Silverman | |
| 3,804,292 | A | | 4/1974 | Chiti | |
| 3,835,930 | A | | 9/1974 | Denigan, Jr. et al. | |
| 3,930,541 | A | * | 1/1976 | Bowman et al. | 169/62 |
| 4,013,190 | A | | 3/1977 | Wiggins et al. | |
| 4,121,666 | A | * | 10/1978 | Rozniecki | 169/62 |
| 4,132,271 | A | * | 1/1979 | Mikaila | 169/62 |
| 4,194,979 | A | | 3/1980 | Gottschall | |
| 4,215,752 | A | | 8/1980 | Waller | |
| 4,251,579 | A | * | 2/1981 | Lee et al. | 428/73 |
| 4,262,749 | A | | 4/1981 | Monte | |
| 4,652,383 | A | | 3/1987 | Tarpley, Jr. et al. | |
| 4,950,410 | A | | 8/1990 | Pennartz | |
| 5,053,147 | A | | 10/1991 | Kaylor | |
| 5,091,097 | A | | 2/1992 | Pennartz | |
| 5,132,030 | A | | 7/1992 | Marx | |
| 5,275,243 | A | | 1/1994 | Williams et al. | |
| 5,304,313 | A | | 4/1994 | Berger | |
| 5,390,580 | A | | 2/1995 | Gibbons, Jr. et al. | |
| 5,393,437 | A | | 2/1995 | Bower | |
| 5,588,493 | A | | 12/1996 | Spector et al. | |
| 5,609,210 | A | | 3/1997 | Galbraith et al. | |
| 5,762,145 | A | * | 6/1998 | Bennett | 169/62 |
| 5,826,664 | A | | 10/1998 | Richardson | |
| 5,833,874 | A | | 11/1998 | Stewart et al. | |
| 5,938,969 | A | | 8/1999 | Morton | |
| 6,019,177 | A | | 2/2000 | Olander | |
| 6,065,545 | A | | 5/2000 | Williams | |
| 6,217,788 | B1 | | 4/2001 | Wucherer et al. | |
| 6,948,567 | B1 | | 9/2005 | Cyphers et al. | |
| 2004/0140105 | A1 | | 7/2004 | Sadr | |

FOREIGN PATENT DOCUMENTS

| | | |
|---|---|---|
| GB | 1445832 | 8/1976 |
| GB | 1453836 | 10/1976 |
| GB | 1454492 | 11/1976 |
| GB | 1454493 | 11/1976 |
| GB | 1496652 | 12/1977 |
| GB | 1547568 | 6/1979 |

OTHER PUBLICATIONS

The book "Fundamentals of Heat and Mass Transfer, Third Edition" (Incropera and DeWitt, John Wiley & Sons, Inc., 1981), pp. 695-749, Fig. 12.23 on p. 725.

* cited by examiner

METHODS AND APPARATUS FOR CONTROLLING HAZARDS

CROSS-REFERENCES TO RELATED APPLICATIONS

This application is a continuation of U.S. Nonprovisional Patent Application No. 09/920,179, filed Aug. 1, 2001. This disclosure was originally filed as Provisional Patent Application 60/225,449, 15 Aug. 2000.

BACKGROUND OF THE INVENTION

1. Field of the Invention

The present invention relates to a fire extinguishing system, More specifically, the present invention relates to improvements, new configurations and new applications for the thin, breakable panels containing dry chemical fire extinguishant, as disclosed in U.S. Pat. No. 5,762,145, typically for use in various transportation applications.

2. Related Art

A device known as a "powder panel" has been disclosed as a rigid or semi-rigid panel (or system of panels) that could be mounted onto the wall of an aircraft fuel tank adjoining and facing an adjacent bay (U.K. Patents 1,454,493 and 1,547,568). These panels, when impacted by a ballistic projectile penetrating through the aircraft, would rupture locally and release a portion of the extinguishant into the adjacent bay, extinguishing instantly the ignition of fuel sprays originating from the damaged fuel tank when contacting hot incendiary particles from the projectile. These panels were demonstrated with a variety of extinguishing gases and dry chemical powders. These panels took the form of hollow panels with cylinders or sachets of extinguishant inserted, or balls or sheets of reticulated foam (sometimes sealed in bags with pressurized gaseous extinguishant). These panels could be parasitically added in retrofit or integrally built into the aircraft structure. All of these evolutionary improvements to the basic panels showed some level of performance enhancement for a given system volume or weight, but could be offset by increased complexity or increased material, assembly or installation cost. In full scale ballistic testing, various configurations have demonstrated successful fire suppression against various threats, but their performance changed as conditions, threats, or compartment configurations changed. The most common panel configurations were thin panels with a hexagonal honeycomb sandwich material of kraft paper, aluminum or Nomex, filled with a fire extinguishing powder and covered with a thin sheet on both faces of aluminum foil, composite fibers or other materials. Such panels would have to be made thicker (if they worked at all) for certain threats such as small caliber projectiles, which limited the extent of local damage to such panels and the resultant amount of powder discharged to extinguish any fires. This minimal panel damage and discharge was due to the ductility of the outer face materials used, which constrained the local face tearing and the ability for the panel's total powder content to be released. Powder panels have some use on current military aircraft, with various trade-offs present versus the use of regular fire extinguishing systems for these applications. This limitation in discharging its total dry chemical content (and resultant required increase in panel thickness and weight) has limited its favorable implementation for many applications versus other alternatives. Variations of this concept were investigated for use against ballistic impacts in armored vehicles (U.S. Pat. Nos. 3,390,541 and 4,132,271), although powders were primarily limited for use in engine compartments due to the inhalation difficulties with crew members, and gaseous extinguishant filled panels were used in the crew compartment. Since weight reduction was the critical factor for military aircraft, special complex, low production prototype systems were considered for use; the considerable cost of materials, assembly and installation of such configurations and exotic extinguishants were not as strong a factor. For military applications it was understood that the total number of units manufactured would be relatively small and costly in comparison to commercial applications, as is common with specialized military equipment.

Crouch (U.S. Pat. No. 2,911,049) discloses a container mounted of a firewall of a vehicle, containing a fire extinguishing chemical inside. An internal flexible rod is suspended vertically within the extinguishing chemical, with a body of significant mass mounted on its end to resemble a pendulum in configuration. When the vehicle decelerates rapidly (such as in a crash), the inertia of the suspended mass will cause it to impact the wall of the mounted container, rupturing it and allowing the dispersal of extinguishing agent The device must experience sufficient deceleration to activate (thus possibly missing activation in low speed crashes), or undesirably break up and disperse its contents under mere hard braking conditions and small incidental impacts. It can also be limited in the location where it can be mounted in bulk form, which may be at locations where it is hard to reach the location of the fire. The fracture of the container may be incomplete and impede the discharge of the total extinguishing chemical contents. If such contents are pressurized, then special high cost and weight materials and sealing means are required to contain the chemical inside during normal operations.

Lee et al (U.S. Pat. No. 4,251,579) discloses a thin panel comprising two thin face sheets, a honeycomb sandwich material and an extinguishing chemical stored inside. The materials of the components were disclosed to include aluminum, stainless steel, resin-impregnated fiber (such as Fiberglass), and woven or non-woven fibrous material (such as Nomex). These constructions required significant fabrication and layup stages to assemble a panel, which could be quite expensive in terms of labor costs for full-scale commercial production. Such assemblies always featured cellular sandwich materials, with such cells (such as hexagonal honeycomb cells) having an axis penetrating both openings of each cell in a perpendicular direction to the planes of the sheet faces. Such face sheet materials in consideration were quite ductile and were designed to tear locally at the point of impact as opposed to shattering in their entirety. Only "projectiles" were disclosed as an initiating means for these panels, and these panels were disclosed as flat or "bendable" flat panels, designed to be placed near a fuel tank to extinguish fires exclusively.

Bennett (U.S. Pat. No. 5,762,145) discloses the design and use of thin, flexible panels that are hollow, with internal structural members forming channels to give the panels some structural rigidity. These panels are filled with dry chemical fire extinguishing powder and sealed. The panels are mounted in regions near reservoirs of flammable fluids, typically on various forms of transportation such as highway vehicles. One of the most common applications would be their mounting on the exterior walls of fuel tanks of vehicles. When the vehicle so outfitted experiences a severe collision while operating on the road, such that the fuel tank is impacted sufficiently to rupture the fuel tank or related connections, the panels mounted on the fuel tank exterior will also rupture. This panel breakage occurs since any impacting force must first penetrate the exterior panels to contact the fuel tank behind the panels. The dry chemical extinguishing powder is thus released in the form of an expanding cloud, due to the energy applied to the powder from the impacting force and the breakage of the panels. This dry chemical powder is very effective in preventing the ignition of the fuel vapor and mist released from the tank rupture, or quickly extinguishing any incipient ignition sites before they grow into established fires. The design of Bennett (U.S. Pat. No. 5,762,145) features design enhancements over prior art by (1) disclosing a means of forming such powder panels in a more economical manner than previously available, (2) disclosing a design that facilitates a more complete fracturing of the panel to optimize the near full discharge of the entire content of powder from a given panel, and (3) proposing a new means of initiating the panel, by means of impact forces due to a collision of a highway vehicle.

The disclosure of Bennett (U.S. Pat. No. 5,762,145) does feature these enhancements, but additional new designs suited for additional applications and alternative vehicle fire scenarios are desired but were not disclosed. As examples, techniques to protect other fire scenarios, such as collisions impacting and fracturing fuel tank valves and their connectors, particularly for alternate fueled vehicles, are desired but not previously disclosed. Additional flammable fluid reservoirs, such as brake master cylinders and fuel pumps, contain sufficient flammable fluid to pose a threat to vehicle occupants or the vehicle itself, and their small, bulky shapes provide difficulties in providing protection using the typical flat panel designs disclosed by Bennett. Some such components, such as the oil pan, may rupture and discharge flammable fluids due to the internal destruction of the engine, which is typically accompanied by the fracturing and penetration of the connecting rods through the oil pan. This scenario is very common in automobile racing in addition to highway occurrences. Other areas of a vehicle, such as the vehicle's engine compartment hood, exhibit damage in front end crashes not discussed by Bennett, and provide an opportunity for the mounting of a powder panel variant suitable for protecting against engine compartment fires. Panel designs disclosed by Bennett only describe panel activation due to collision-induced impacts, as opposed to heat activation, such as resulting from a small pool fire established under the fuel tank which poses the risk of burning through the tank and dumping significant quantities of fuel to exacerbate the fire event. Other threats to a vehicle and its occupants exist after a collision in addition to the presence of a fire, such as the discharge of battery acid from a ruptured battery, which were not addressed by Bennett. This threat is compounded for the large battery compartments present with electric or hybrid vehicles. One-piece powder panels formed by a single extrusion process, such as disclosed and illustrated by Bennett, may provide a low cost means of forming such panels. Such a design may not result in a panel with optimal panel weight minimization. It may also compromise optimal breakage of the panel due the strength of the internal ribs formed within the panel, the strength of its attachment to the outer face (with its characteristic of inhibiting favorable crack propagation), and the less than optimal fracture behavior of the outer face. The outer face, the component which is desired to fracture considerably, may fracture to a lesser extent when it is made of the same material as the rest of the panel (due to the necessity of forming the panel in one piece from one material), the material having been chosen to meet other mounting and strength requirements of the overall panel design during normal operation.

In summary, it is desired to provide a design of the powder panel concept (with or without usage of dry chemical powders as extinguishants) that can provide protection for other previously undisclosed fire scenarios and component failures, such as brake cylinders, fuel pumps, oil pans, fuel system valves, attachments and other front and engine compartment impacts and fires. It is also desired to have the ability for such powder panels to be activated by excessive heat, such as is due to a burning fire in proximity to the panel. It is also desired that the powder panels provide protection against other threats to occupants and the environment due to vehicle impacts, such the rupture and release of dangerous and caustic chemicals such as battery acids. It is also desired that such panels be designed whereby the outer face can be optimally constructed to fracture sufficiently due the selection of proper brittle materials, and the ability to limit the attachment strength of the outer face to the internal panel ribs to minimize the inhibition of the desired crack propagation, to maximize outer face breakup and resultant powder discharge. No device has been demonstrated that incorporates these features for this application.

SUMMARY OF THE INVENTION

The principal object of the present invention is to provide a means of extinguishing or preventing fires on board vehicles (including aircraft) due to crashes, or other related threats to vehicle occupants and the environment.

Another object of the present invention is to provide protection against fires resulting from damage to flammable fluid reservoirs on board vehicles due to collisions or other vehicle malfunctions, in addition to the fuel tank.

Another object of the invention is to provide protection against fires resulting from a collision of a vehicle originating in the front of the vehicle or other locations in addition to the fuel tank region.

Another object of the invention is to provide a means of extinguishing fires when activated by the heat generated from the fire itself Another object of the invention is to provide protection of vehicle occupants, pedestrians, rescue personnel and the environment due to the release of toxic, caustic or corrosive chemicals released due to a collision.

Another object of the invention is to provide efficient extinguishment of vehicle fires due to the optimal discharge of fire extinguishing chemical from the protection device.

The foregoing objects can be accomplished by adding additional features to the powder panel concept previously disclosed in prior art. They include fabricating and configuring powder panels in the form of cylindrical tubes or sleeves that fit closely to the flammable fluid reservoirs they are designed to protect. Such panels can also be configured as hood liners that fracture when the vehicle hood is deformed in a collision to deposit a cloud a extinguishing powder over the engine compartment to prevent the establishment of fires in that region, or covers over oil pans to prevent similar establishment of oil fires. Such panels can be activated by fracturing when subject to heat from an initial fire due to thermal stresses developed within the panel, to quickly extinguish or suppress the growth of such fires. These panels can also be mounted on the enclosures of toxic, corrosive or caustic chemicals, such as battery cases, to neutralize the chemical reactivity of such chemicals when released due a collision-induced rupture, when such panels are filled with the appropriate neutralizing agent. The panels can be formed by adding an outer face of differing material or thickness than the inner face and ribs of the panel, designed to totally fracture in a more complete manner than the remainder of the panel, and with reduced inhibition of the desired crack propagation, panel shattering and powder release characteristics after impact due to a purposely weakened attachment means between the outer face and the rest of the panel. These enhanced design features can satisfy all of the objects stated previously, whereas prior art cannot satisfy all of the objects in their entirety.

FIG, 8 is a side elevation and cross section of the invention, revealing its two-component materials and attachment means of the two components.

DETAILED DESCRIPTION

Figure 1:
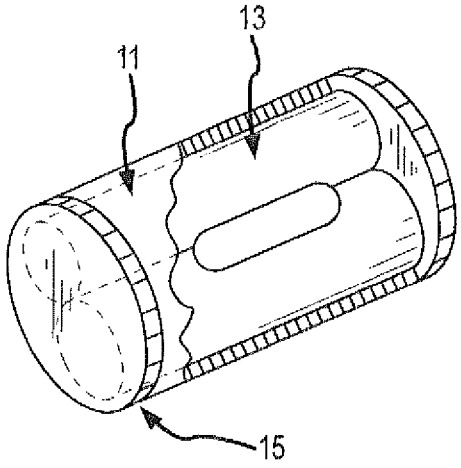
FIG. 1 is an isometric view and section in part of a fuel pump shrouded with a variation of the invention.

Refer now to FIG. 1, which is a drawing of a variation of the invention covering a vehicle fluid reservoir, a notional fuel pump for an internal combustion engine in this embodiment. The invention, in the form of a shroud 11, is shaped to fit rather snugly over the fuel pump 13 as a press fit. It may be attached by additional means such as an additional face of the shroud that is attached at the base of the fuel pump near its attachment to the engine. Other attachment means such as outer band clamps or internal adhesive may also be used if desired. The invention may have a separate end plate 15 that is attached (adhesively or otherwise) to the end of the invention near the outer end of the fuel pump, particularly if simple cylindrical geometries are used to form the base of the body of the invention. The invention may be made of thin double-walled plastic, with internal ribs to form channels to fill with fire extinguishant such as common dry chemical powder, although other construction means and fire extinguishing chemicals are possible. The invention may also be injection molded or otherwise cast to form a precise shape of the fluid component to be covered. When a fluid reservoir, such as the fuel pump 13 in this embodiment, is impacted sufficiently (such as in an accident) to break off or partially disconnect the fuel pump from the engine, facilitating the discharge of its flammable fluid contents and its subsequent ignition, the invention 11 shroud should also break apart due to the same impact, releasing a cloud of extinguishant around the region of fluid discharge to mitigate ignition and any resultant fires. Other common reservoirs can incorporate the invention by similar means, including power steering pumps, vapor canisters, brake master cylinders, oil pumps and washer fluid reservoirs. Fuel pressure reduction valves, and other valves attached to fluid vessels such as those on compressed natural gas (CNG) tanks, liquefied petroleum gas tanks (LPG), hydrogen tanks and other alternate fueled vehicles are suitable for such shrouds to cover them, in the event they are disconnected as the result of a collision.

Figure 2:
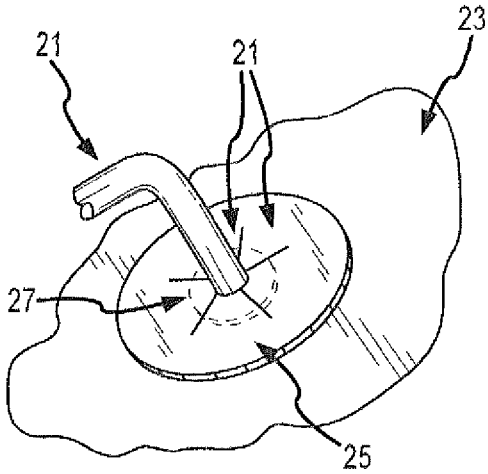
FIG. 2 is an isometric view of a fluid reservoir fitting surrounded by a variation of the invention at the location of connection of the reservoir to the fluid line.

FIG. 2 illustrates the connection point of a fluid line 21 to a fluid reservoir 23. In this embodiment, the invention is in the form of a disk 25 or similar shape that covers the attachment point of the fluid line 21 and reservoir 23, attached to the surrounding face of the reservoir 23, of sufficient internal volume to contain enough dry chemical powder to prevent the ignition of any fluids released by the separation of line 21 and reservoir 23, such as due to an accident. For example, a 4-mm thick powder panel of polycarbonate construction has been shown to contain approximately 2 grams of sodium bicarbonate per square inch of panel, with less than 10 grams of such powder mixed with air having been shown in prior experiments to prevent the spark ignition of the vapors from a small gasoline pool in air. Actual attachment means of the fluid lines 21 to their respective reservoirs 23 should include a washer 27 that is firmly attached to the fluid line 21 itself in the preferred embodiment. Additional scored fracture lines 29 may also be added to the outer faces of the powder panel disk 25 itself. If an event occurs that results in the pulling of the fluid line 21 sufficiently as to separate it from the reservoir 23 (such as due to a collision), then the washer 27 (attached to the fluid line) pulls through the powder panel disk 25, rupturing its contents of fire extinguishing chemical around the surrounding area to suppress the ignition of fluid discharging from the disconnected line in the local area. The firm attachment of the disk 25 to the reservoir 23 (such as by modern adhesives, known to those skilled in the art), facilitates the breaking of the panel in resisting its translational movement along with the separating fluid line, with the optional scored fracturing lines 29 also assisting in the weakening and breakup of the panel to facilitate the discharge of the extinguishing chemical, if needed.

Figure 3:
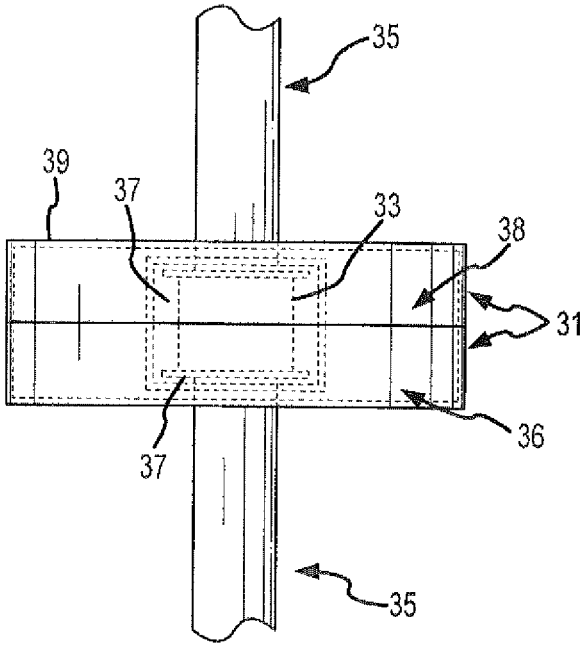
FIG. 3 is a side elevation view of a variation of the invention fitted over a connector of two fluid line fittings.

FIG. 3 is a side view of a similar application of the invention 31 to protect the region of a coupling 33 connecting together two fluid lines 35. The invention 31 takes the form of two disks, whose faces are rigidly attached to each other (such as by use of modern adhesives 38), with a recessed area and cavity 39 to accommodate any coupling 33 for the two lines 35. Each fuel line 35 also features a flange 37 rigidly attached to each fuel line, outside of the coupling but captured within the disks 31 when they are attached together. The outer faces of the disks 31 may also have their surfaces scored radially from their fuel line openings to assist in panel breakup If the two ends of the fluid line 35 were to be pulled apart (such as due to a collision) and disconnect at the site of the coupling 33, the flange 37 of either fluid line 35 (or both) will pull through the panel disks 31 and shatter them, discharging fire extinguishing chemical 36 at the same time to prevention the ignition of any fluids discharged from the disconnecting lines. The adhesive force between the faces of the disks 31 is designed to be stronger than the force required to fracture either disk by a flange 37 on either line, to assure that disk fracturing occurs.

Figure 4:
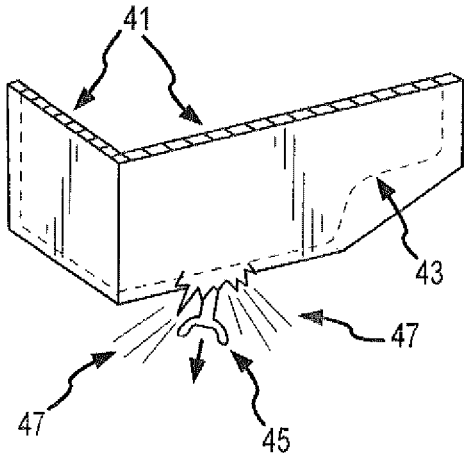
FIG. 4 is a diagrammic perspective view of a variation of the invention enclosed over an oil pan of an internal combustion engine, with a connecting rod breaking through the oil pan and the outer panel.

FIG. 4 is an illustration of the invention formed as a shroud 41 over an oil pan 43, either as a tightly fitting shroud which has been molded from liquid plastic or formed from double wall material, or a rectangular formation of flat double-wall panels in the general shape of the oil pan. If the engine to which the oil pan 43 is attached breaks a connecting rod 45 and propels it through the oil pan 43, discharging oil and fuel, the shroud 41 is also broken, discharging the fire extinguishing chemical contents 47 as a cloud to prevent the ignition of the released oil and fuel near the exhaust manifold or other ignition sources. The shroud 41 may also be placed as a sheet or curved panel some distance away from the oil pan 43, but within proximity of the oil pan 43 sufficient to assure its rupture from the discharged engine components.

Figure 5:
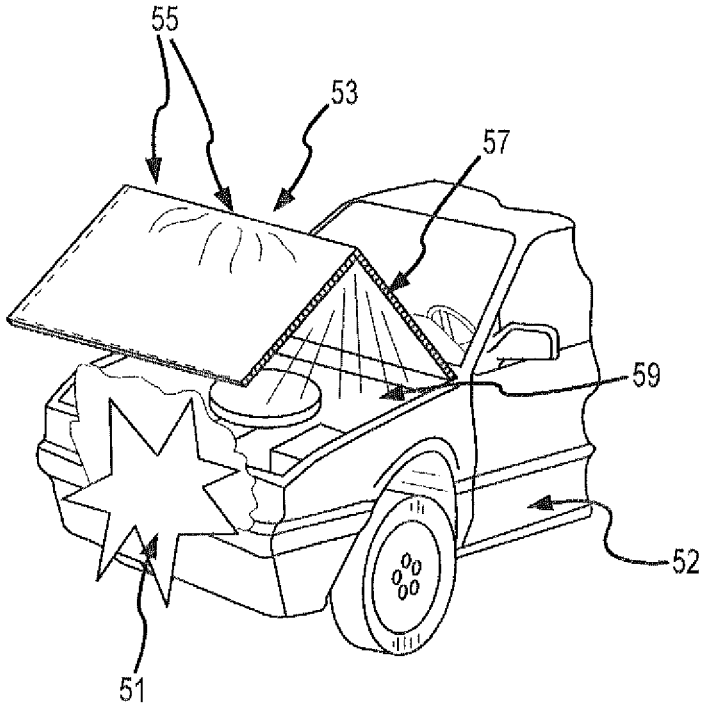
FIG. 5 is a diagrammic perspective view of a vehicle front-end collision, with the engine compartment hood deforming and breaking the hood liner variant of the invention.

FIG. 5 is an illustration of a vehicle collision impact in the engine compartment, typically in the front of the vehicle. In the event of severe types of these collisions, substantial deformation of the front of the vehicle occurs, rupturing and discharging many different types of flammable fluids in many cases, and exposing them to multiple ignition sources such as loose spark plug wires, other exposed wiring, hot surfaces and grinding sparks. In such incidents, vehicle hoods are designed to bend near their center point to dissipate energy and to prevent their disconnection at their hinges, which might possibly drive them toward the occupants inside. In such a front impact 51 of a vehicle 52, the vehicle hood 53 deforms as normally designed, forming a crease 55 along a pre-set failure line. In this case, the invention is installed as a hood liner 57, filled with fire extinguishing chemical (most likely dry chemical powder), and formed to the general shape of the underside of the hood 53. The liner 57 may have surface coverings to feature sound dampening, or have special sound dampening material added between the liner 57 and the hood 53. When the hood 53 deforms in a collision, the liner 57 also deforms until it fractures. Preferential scored lines on the liner 57 may also assist in the breakup of the liner. The fire extinguishing chemical contents 59 within the liner 57 are thus discharged down onto the engine compartment, to prevent any fires that might result from the previously described encounter of discharged fluid and ignition sources.

Figure 6:
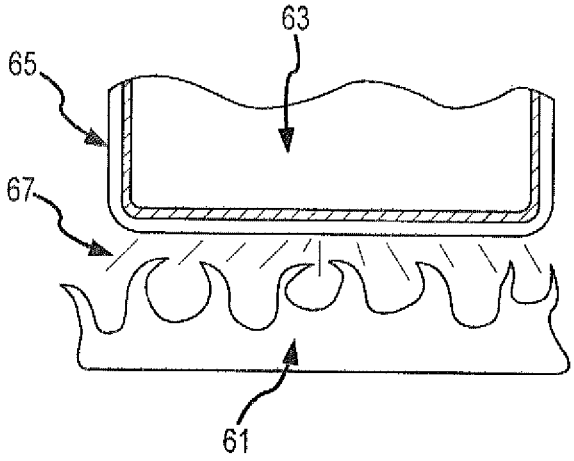
FIG. 6 is a side elevation of a pool fire impinging on a liquid reservoir, with the invention serving as an outer covering of the reservoir and fracturing due to the thermal stresses imposed by the pool fire, releasing its powder contents.

FIG. 6 is an illustration of an established pool fire 61 underneath a fluid reservoir, such as a fuel tank 63. The fuel tank 63 has a shroud 65 placed over the tank, containing the fire extinguishing chemical. The shroud 65 may be a series of flat panels (filled with fire extinguishing chemical) placed on the outer surfaces of the fuel tank 63, a pre-formed and molded shape that conforms to the outer shape of the fuel tank 63, or actually molded into the outer surface of the tank 63 itself, if it is a plastic tank (with a means to fill the outer shroud chamber with fire extinguishing chemical, if this configuration is selected). The shroud 65 is designed such that extreme thermal stresses applied to the panel, such as from a pool fire 61 a few inches from it, will cause it to crack and fracture. If the bottom panel (facing the pool fire 61 on the ground) is a flat panel that is constrained by a rigid frame on its perimeter, the role of the frame in restraining the thermal expansion of the panel can result in extreme stresses within the panel that cause its cracking and rupture (such as glass windows that break out in a house or car that is on fire). If such a panel is plastic, sufficient stresses must be created within a panel to rupture it at a temperature below its melting point. Brittle plastics such as acrylic can be ideal for such applications. Internal stresses can be applied via pre-loading the panels in a frame or by other heat treatments such that minimal additional thermal stresses are required to achieve the fracture condition. If the concept of the invention is packaged within a preformed fuel tank, with an outer shell also formed which is filled with dry chemical extinguishant in accordance of the invention, then such pre-loading can occur by careful control of the forming and post-heating processes. Such a technique could be applied to plastic tanks which are molded and are in abundant use today, but which may be particularly vulnerable to failure when exposed to pool fires established underneath them. When such a pool fire 61 occurs underneath a fuel tank 63, the fire extinguishing panel or layer 65 can crack and break up due to the resultant thermal loading and discharge its contents of fire extinguishing chemical 67, either extinguishing the pool fire or greatly mitigating it.

Figure 7:
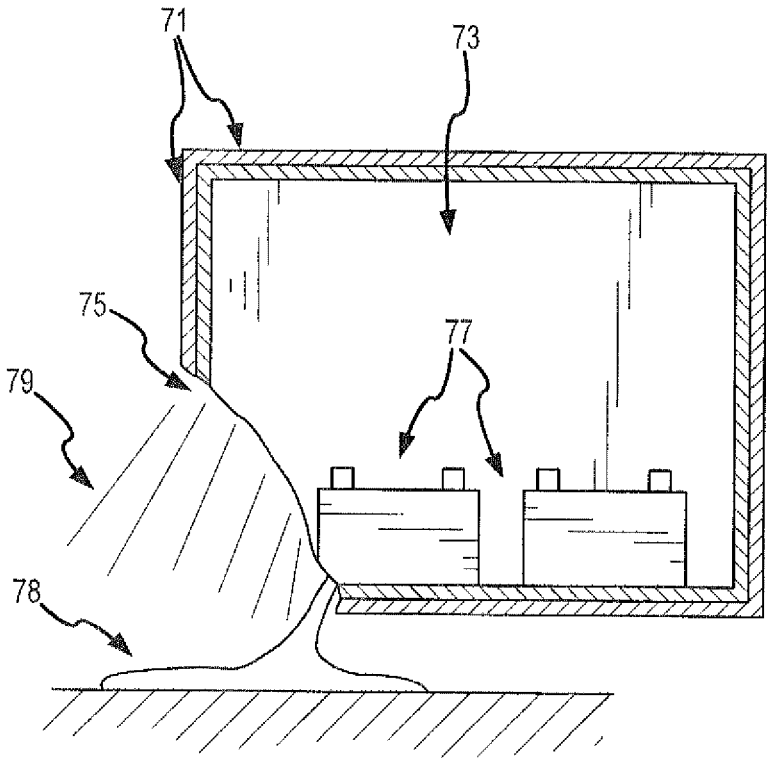
FIG. 7 is a side elevation of an enclosure covered by a variation of the invention and containing multiple batteries, the enclosure and batteries having been damaged (such as in a collision) with caustic battery acid and powder from the invention released from the enclosure.

FIG. 7 is an illustration of an enclosure that houses batteries, such as might be used on an electric vehicle. If such a container is ruptured, such as due to a collision, and the enclosure is ruptured as well as the batteries, caustic and corrosive battery acids can be released to the environment. These acids pose a hazard to the vehicle occupants, the environment, rescue personnel and those hired to inspect the wreckage and transport it to a safe area. There is concern today with the proliferation of electric vehicles as to mitigating this threat, since large banks of batteries are used in modern electric vehicles. In this embodiment the protective panels 71 of the invention are placed on the exterior of the battery enclosure 73. If the enclosure 73 is damaged, such as in a collision, the ruptured area 75 of the enclosure 73 permits the spillage of acid from the damaged batteries 77. The acid 78 spilt from the batteries thus flows to the ground or to other areas external to the enclosure 73. Since the protective panels 71 are also ruptured since they cover the exterior of the enclosure 73, they discharge their contents of neutralizing chemical 79 to render the spilled acid relatively harmless. Many such chemicals could be used to render battery acid harmless, but one candidate is one most likely to be used for fire extinguishing duties as well—sodium bicarbonate (baking soda). This technique and configuration can be used for any application where the potential for a spill of some caustic, corrosive or toxic chemical could occur due to a vehicle collision. This scenario includes tractor-trailers and other transport vehicles that haul such caustic and dangerous chemicals in large quantities, which could implement coverings consistent with this embodiment of the invention. A simple panel covering or cabinet for the single battery used on virtually all vehicles could be employed to prevent excessive damage resulting from a potential leakage or spray of battery acid within the engine compartment, or toward operators if the battery is damaged in a collision or explodes due to other insults applied to the battery (assuming the explosion is severe enough to rupture the covering and pose an external threat).

Figure 8:
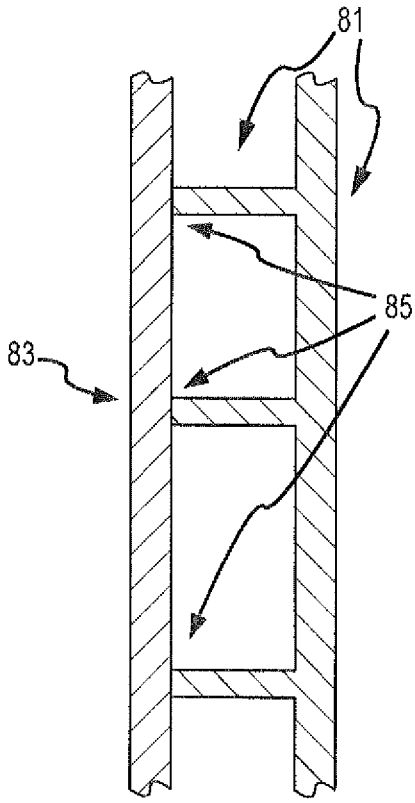

FIG. 8 is a side view of a further improvement to the typical panel design to aid in its fill discharge of extinguishing chemical when impacted. It is possible in some cases that the ribs formed within typical fire extinguishing panels, when formed as a single one-piece extrusion, can possibly impede the beneficial crack formation of the outer face when impacted, thereby limiting the breakup of the outer face and the more complete discharge of the dry chemical contents. In addition, the selection of materials chosen to make up the rest of the panel structure, including the internal ribs and inner face, may not be optimal for the outer face. The inner face and ribs are typically favored to be produced of low cost material, and strong enough to withstand normal operational stresses. This is particularly true when the panels are made as one-piece plastic extrusions. In this case, it may be desired to fabricate the inner face 81 and ribs 81 one piece of polycarbonate, for example, and fabricate the outer face 83 in acrylic, which may be more expensive but is more prone to total breakage when impacted. In addition, the two dissimilar pieces can be joined by adhesive means 85 that has limited bond strength, sufficient only for normal operational environments. The limited strength of these bonds should impede the crack propagation of the outer face 83 to a minimal degree, and improve the ability of the outer face 83 (in its entirety or in pieces) to separate from the ribs 81, thereby improving powder discharge.

There is thus described novel techniques and features to improve the performance of fire extinguishing panel devices, for new applications as well, which meets all of its stated objectives and which overcomes the disadvantages of existing techniques.

The foregoing description of the preferred embodiments of the invention has been presented for purposes of illustration and description. It is not intended to be exhaustive or limit the invention to the precise form disclosed. Many modifications and variations are possible in light of the above teaching. It is intended that the scope of the invention be limited not by this detailed description, but rather by the claims appended hereto.

I claim:

1. A hazard control system for a hazardous material container, comprising:

a one-piece non-planar shatterable container configured to contain a hazard control material and comprising a first surface and a second surface and comprising a surface area, wherein:

the first surface comprises a first material with a first brittleness;

the second surface comprises a second material with a second brittleness;

a majority of the surface area of the container comprises the first surface and the second surface; and a majority of the first surface is non-planar and configured to substantially conform to and substantially cover a non-planar exterior surface of the hazardous material container.

2. A hazard control system according to claim 1, wherein the first surface of the shatterable container is further configured to conform to the exterior surface of the hazardous material container comprising a fluid reservoir.

3. A hazard control system according to claim 1, wherein the shatterable container further comprises a disk, wherein the disk is configured to at least partially enclose a connection point between an exterior line and the hazardous material container.

4. A hazard control system according to claim 1, further comprising a breaking element configured to be attached to the hazardous material container and disposed adjacent the shatterable container such that the breaking element breaks the shatterable container when a movement of the hazardous material container moves the breaking element by a selected amount relative to the shatterable container.

5. A hazard control system according to claim 4, wherein the shatterable container includes a surface having a scoring coincident with a movement path for the movement of the breaking element relative to the shatterable container.

6. A hazard control system according to claim 1, wherein the hazard control material is configured to reduce at least one of a flammability, a causticity, a toxicity, and a corrosiveness of a hazardous material.

7. A hazard control system according to claim 1, wherein the shatterable container substantially surrounds the hazardous material container.

8. A hazard control system according to claim 7, wherein the hazardous material container includes an interior surface and an exterior surface, and wherein the shatterable container substantially covers at least one of the hazardous material container interior surface and the hazardous material container exterior surface.

9. A container for containing a hazardous material, comprising:

a housing configured to contain the hazardous material comprising a three dimensional non-planar surface;

a hazard control material; and a one-piece non-planar shatterable container containing the hazard control material and comprising a first surface and a second surface, wherein:

the first surface comprises a first material with a first brittleness;

the second surface comprises a second material with a second brittleness;

a majority of the surface area of the shatterable container is formed by the first surface and the second surface; and a majority of the first surface is non-planar and configured to substantially conform to and substantially cover the contoured surface of the housing.

10. A container according to claim 9, wherein the housing comprises a fluid reservoir.

11. A container according to claim 9, wherein the container further comprises a disk, wherein the disk is configured to at least partially enclose a connection point between an exterior line and the housing.

12. A container according to claim 9, further comprising a breaking element configured to be attached to the housing and disposed adjacent the shatterable container such that the breaking element breaks the shatterable container when a movement of the housing moves the breaking element by a selected amount relative to the shatterable container.

13. A container according to claim 12, wherein the shatterable container includes a surface having a scoring along a movement path for the movement of the breaking element relative to the shatterable container.

14. A container according to claim 9, wherein the hazard control material is configured to reduce at least one of a flammability, a causticity, a toxicity, and a corrosiveness of the hazardous material.

15. A container according to claim 9, wherein the shatterable container includes a surface having a scoring.

16. A container according to claim 9, wherein the shatterable container substantially surrounds the housing.

17. A container according to claim 16, wherein the housing includes an interior surface and an exterior surface, and wherein the shatterable container substantially covers at least one of the housing interior surface and the housing exterior surface.

18. A method for controlling a hazard of a hazardous material in a non-planar housing, comprising:

securing a one-piece non-planar shatterable to the housing, wherein the shatterable container comprises a first surface with a first brittleness and a second surface with a second brittleness;

wherein the shatterable container has a surface area, wherein the majority of the surface area comprises a surface area of the first surface and a surface area of the second surface;

wherein a majority of the first surface is non-planar and configured to substantially conform to the housing; and disposing a hazard control material in the shatterable container.

19. A method according to claim 18, wherein the housing comprises a fluid reservoir.

20. A method according to claim 18, wherein the shatterable container is configured to at least partially enclose a connection point between a fluid line and a reservoir of the housing.

21. A method according to claim 18, further comprising a breaking element configured to be attached to the housing and disposed adjacent the shatterable container such that the breaking element breaks the shatterable container when a movement of the housing moves the breaking element by a selected amount relative to the shatterable container.

22. A method according to claim 21, wherein the shatterable container includes a surface having a scoring along a movement path for the movement of the breaking element relative to the shatterable container.

23. A method according to claim 18, wherein the hazard control material is configured to reduce at least one of a flammability, a causticity, a toxicity, and a corrosiveness of a hazardous material.

24. A method according to claim 18, wherein the shatterable container includes a surface having a scoring.

* * * * *